US010641044B2

(12) United States Patent
Sadabadi et al.

(10) Patent No.: US 10,641,044 B2
(45) Date of Patent: May 5, 2020

(54) VARIABLE STIFFNESS FIXED BEND HOUSING FOR DIRECTIONAL DRILLING

(71) Applicant: Halliburton Energy Services, Inc., Houston, TX (US)

(72) Inventors: Hamid Sadabadi, Edmonton (CA); Kennedy Kirkhope, Nisku (CA)

(73) Assignee: Halliburton Energy Services, Inc., Houston, TX (US)

( * ) Notice: Subject to any disclaimer, the term of this patent is extended or adjusted under 35 U.S.C. 154(b) by 92 days.

(21) Appl. No.: 15/531,187

(22) PCT Filed: Dec. 29, 2014

(86) PCT No.: PCT/US2014/072563
§ 371 (c)(1),
(2) Date: May 26, 2017

(87) PCT Pub. No.: WO2016/108823
PCT Pub. Date: Jul. 7, 2016

(65) Prior Publication Data

US 2017/0350192 A1 Dec. 7, 2017

(51) Int. Cl.
*E21B 7/06* (2006.01)
*E21B 17/00* (2006.01)

(52) U.S. Cl.
CPC ..... *E21B 7/062* (2013.01); *E21B 7/067* (2013.01); *E21B 17/00* (2013.01)

(58) Field of Classification Search
CPC . E21B 7/062; E21B 7/04; E21B 17/00; E21B 7/067
See application file for complete search history.

(56) References Cited

U.S. PATENT DOCUMENTS 4,227,584 A 10/1980 Driver
4,597,454 A 7/1986 Schoeffler
4,817,740 A 4/1989 Beingraben
(Continued)

FOREIGN PATENT DOCUMENTS

EP 561072 A1 9/1993
GB 2427222 A 12/2006
(Continued)

OTHER PUBLICATIONS

International Preliminary Report on Patentability issued in related Application No. PCT/US2014/072563, dated Jul. 13, 2017 (13 pages).
(Continued)

*Primary Examiner* — Taras P Bemko
*Assistant Examiner* — Dany E Akakpo
(74) *Attorney, Agent, or Firm* — Alan Bryson; Baker Botts L.L.P.

(57) ABSTRACT

An example apparatus for controlling the direction of drilling a borehole includes an outer housing having non-uniform stiffness and an inner housing at least partially within and rotationally independent from the outer housing and having non-uniform stiffness, A drive shaft may be at least partially within the inner housing. At least one of the outer housing and the inner housing may include a tubular structure with at least one of multiple materials with different stiffness, and a portion with less structural material than another portion.

22 Claims, 5 Drawing Sheets

(56) References Cited

U.S. PATENT DOCUMENTS

| | | | | |
|---|---|---|---|---|
| 5,052,501 | A | 10/1991 | Wenzel et al. | |
| 5,135,059 | A | 8/1992 | Turner et al. | |
| 5,673,765 | A | 10/1997 | Wattenburg et al. | |
| 5,857,531 | A | 1/1999 | Estep et al. | |
| 5,979,570 | A * | 11/1999 | McLoughlin | E21B 47/18 175/24 |
| 6,082,470 | A | 7/2000 | Webb et al. | |
| 6,092,610 | A | 7/2000 | Kosmala et al. | |
| 6,394,193 | B1 | 5/2002 | Askew | |
| 6,550,818 | B2 | 4/2003 | Robin | |
| 6,640,909 | B2 | 11/2003 | Vandenberg et al. | |
| 6,847,304 | B1 * | 1/2005 | McLoughlin | E21B 47/12 175/45 |
| 6,892,830 | B2 | 5/2005 | Noe et al. | |
| 7,195,083 | B2 | 3/2007 | Eppink et al. | |
| 7,234,544 | B2 | 6/2007 | Kent | |
| RE39,970 | E | 1/2008 | Askew | |
| 7,588,082 | B2 | 9/2009 | Lasater | |
| 8,286,733 | B2 | 10/2012 | Tulloch et al. | |
| 8,353,348 | B2 | 1/2013 | Chitwood et al. | |
| 8,590,636 | B2 | 11/2013 | Menger | |
| 8,739,901 | B2 | 6/2014 | Cole | |
| 2002/0185315 | A1 | 12/2002 | McLoughlin et al. | |
| 2004/0084219 | A1 * | 5/2004 | Moore | E21B 4/18 175/73 |
| 2004/0173381 | A1 | 9/2004 | Moore et al. | |
| 2005/0056463 | A1 * | 3/2005 | Aronstam | E21B 7/062 175/61 |
| 2009/0260884 | A1 | 10/2009 | Santelmann | |
| 2011/0116959 | A1 | 5/2011 | Akbari et al. | |
| 2011/0155466 | A1 * | 6/2011 | Gibb | E21B 7/067 175/61 |
| 2011/0240370 | A1 | 10/2011 | Shwets et al. | |
| 2011/0284292 | A1 | 11/2011 | Gibb et al. | |
| 2013/0153297 | A1 | 6/2013 | Abney et al. | |
| 2013/0213713 | A1 | 8/2013 | Smith et al. | |
| 2014/0083777 | A1 | 3/2014 | Korchounov | |
| 2014/0131106 | A1 | 5/2014 | Coull et al. | |

FOREIGN PATENT DOCUMENTS

| | | | |
|---|---|---|---|
| WO | 2014098892 | A1 | 12/2012 |
| WO | 2014/144256 | A1 | 9/2014 |

OTHER PUBLICATIONS

International Search Report and Written Opinion issued in related PCT Application No. PCT/US2014/072563 dated Sep. 1, 2015, 17 pages.

Office Action issued in related Russian application No. 2017111982 dated Mar. 23, 2018 (4 pages).

Search report issued in related Malaysian application No. PI 2017000602 dated Feb. 11, 2020 (3 pages).

* cited by examiner

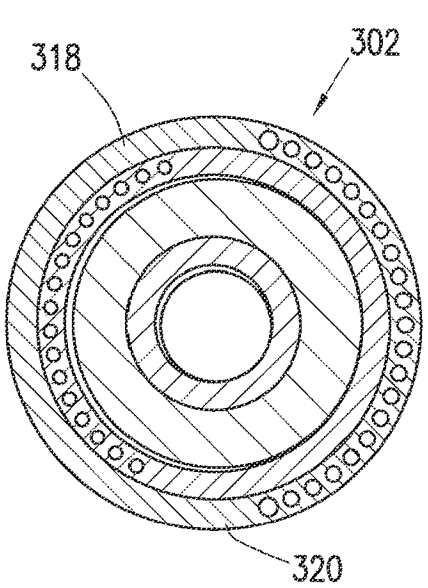
FIG. 3B3
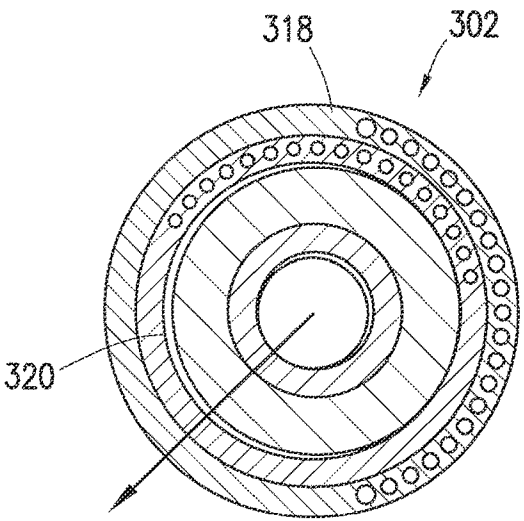
FIG. 3B2
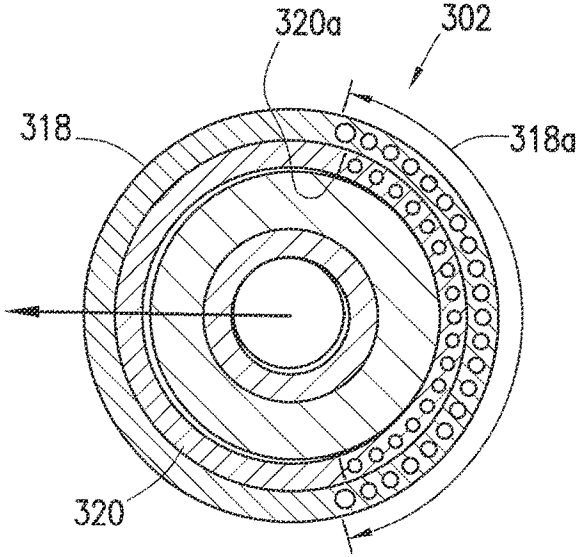
FIG. 3B1

VARIABLE STIFFNESS FIXED BEND HOUSING FOR DIRECTIONAL DRILLING

CROSS-REFERENCE TO RELATED APPLICATION

The present application is a U.S. National Stage Application of International Application No. PCT/US2014/072563 filed Dec. 29, 2014, which is incorporated herein by reference in its entirety for all purposes.

BACKGROUND

The present disclosure relates generally to well drilling operations and, more particularly, to a variable stiffness fixed bend housing for directional drilling.

Hydrocarbons, such as oil and gas, are commonly obtained from subterranean formations that may be located onshore or offshore. The development of subterranean operations and the processes involved in removing hydrocarbons from a subterranean formation may be complex. Typically, subterranean operations involve a number of different steps such as, for example, drilling a wellbore, at a desired well site, treating the wellbore to optimize production of hydrocarbons, and performing the necessary steps to produce and process the hydrocarbons from the subterranean formation.

Drilling a wellbore may include introducing a drill bit into the formation and rotating the drill bit to extend the wellbore. In certain operations, it may be necessary to control the direction in which the wellbore is being extended by altering the axis of the drill bit with respect to the wellbore. This is typically accomplished using complex mechanisms that increase the costs associated with the drilling operation.

FIGURES

Some specific exemplary embodiments of the disclosure may be understood by referring, in part, to the following description and the accompanying drawings.

FIGS. 3A and 3B are diagrams illustrating another example downhole tool, according to aspects of the present disclosure.

Figure 1:
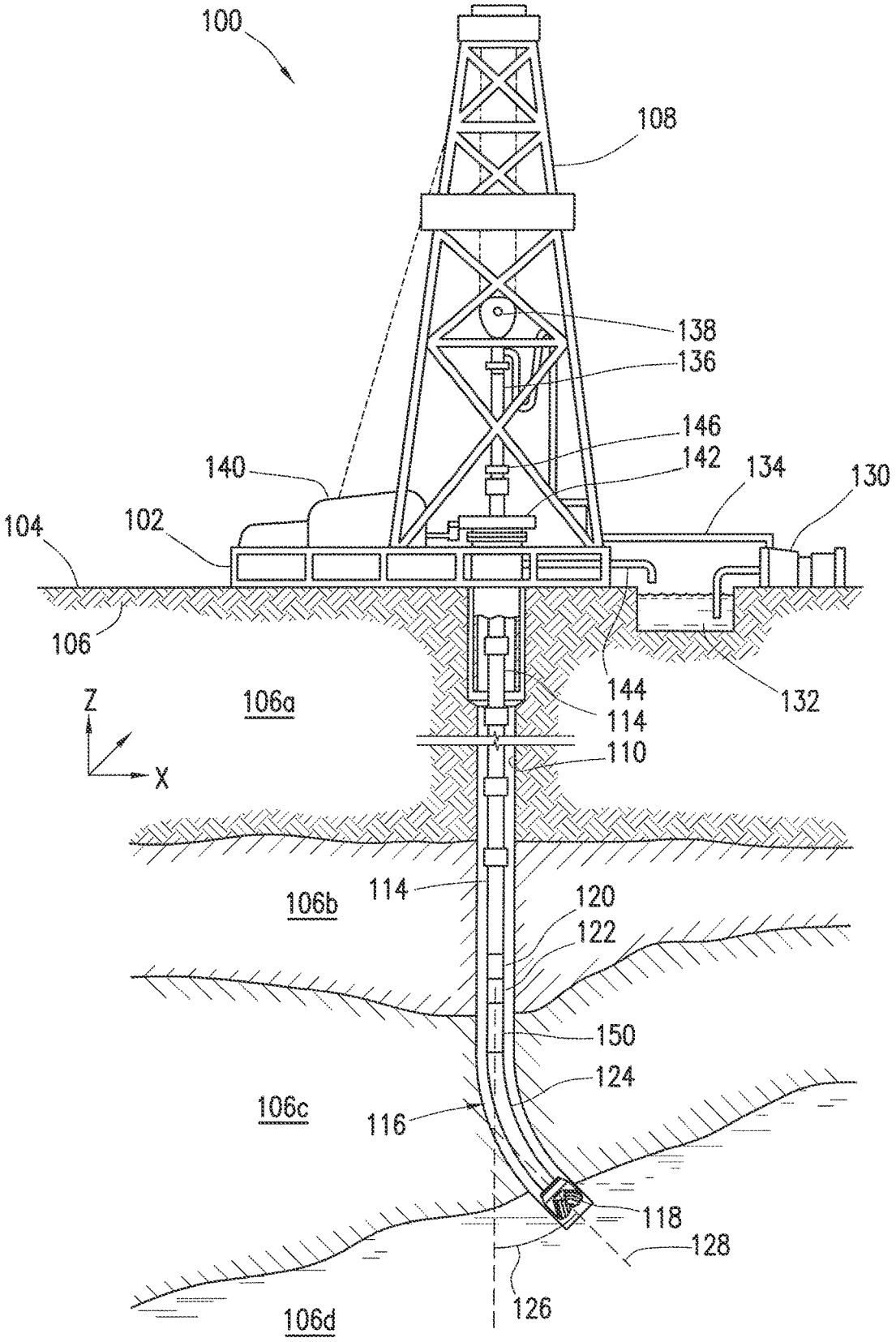
FIG. 1 is a diagram illustrating an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The disclosed embodiments are provided by way of example only, and are not exhaustive of the scope of the disclosure.

DETAILED DESCRIPTION

In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like.

Certain systems and methods are discussed below in the context of petroleum drilling and production operations in which information is acquired relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

The terms "couple" or "couples" as used herein may involve either a direct or indirect connection. For example, two mechanically coupled devices may be directly mechanically coupled when the mechanical coupling involves close or direct physical contact between the two devices, or indirectly mechanically coupled when the two devices are each coupled to an intermediate component or structure. The term "communicatively coupled" as used herein generally refers to an electronic (or, in some cases, fluid) connection via which two elements may electronically (or fluidically) communicate. An electronic coupling typically enables electrical power and/or data flow between elements. Such an electronic connection may involve a wired and/or wireless connection, for example, using Wifi, Bluetooth, or other wireless protocol, LAN, co-axial wiring, fiber-optic wiring, hard-wired physical connections, circuit board traces, or any other electronic signal medium or combinations thereof. As with direct and indirect physical connections, a first device may be directly communicatively coupled to a second device, such as through a direct electronic connection, or indirectly communicatively coupled, via intermediate devices and/or connections.

FIG. 1 is a diagram of an example subterranean drilling system 100 in which an axis of a drill bit 118 may be altered downhole using a variable stiffness housing 124, according to aspects of the present disclosure. The drilling system 100 comprises a drilling platform 102 positioned at the surface 104. In the embodiment shown, the surface 104 comprises the top of a formation 106 containing one or more rock strata or layers 106*a-d*, and the drilling platform 102 may be in contact with the surface 104. In other embodiments, such as in an offshore drilling operation, the surface 104 may be separated from the drilling platform 102 by a volume of water.

The drilling system 100 comprises a derrick 108 supported by the drilling platform 102 and having a traveling block 138 for raising and lowering a drill string 114. A kelly 136 may support the drill string 114 as it is lowered through a rotary table 142 into a borehole 110. A pump 130 may circulate drilling fluid through a feed pipe 134 to kelly 136, downhole through the interior of drill string 114, through orifices in a drill bit 118, back to the surface via an annulus 140 formed by the drill string 114 and the wall of the borehole 110. Once at the surface, the drilling fluid may exit the annulus 140 through a pipe 144 and into a retention pit 132. The drilling fluid transports cuttings from the borehole 110 into the pit 132 and aids in maintaining integrity or the borehole 110.

The drilling system 100 may comprise a bottom hole assembly (BHA) 116 coupled to the drill string 114 near the drill bit 118. The BHA 116 may comprise a LWD/MWD tool 122 and a telemetry element 120. The LWD/MWD tool 122 may include receivers and/or transmitters (e.g., antennas capable of receiving and/or transmitting one or more electromagnetic signals). As the borehole 110 is extended by drilling through the formations 106, the LWD/MWD tool 122 may collect measurements relating to various formation properties as well as the tool orientation and position and various other drilling conditions. The telemetry sub 120 may be coupled to other elements within the BHA 116, e.g., the LWD/MWD tool 122, and may transmit data to and receive data from the surface via a surface transceiver 146, the data corresponding or directed to one or more of the elements within the BHA 116. The telemetry sub 120 may transmit measurements or data through one or more wired or wireless communications channels (e.g., wired pipe or electromagnetic propagation). Alternatively, the telemetry sub 120 may transmit data as a series of pressure pulses or modulations within a flow of drilling fluid (e.g., mud-pulse or mud-siren telemetry), or as a series of acoustic pulses that propagate to the surface through a medium, such as the drill string 114.

In certain embodiments, the system 100 may further comprise a downhole motor 150 and a variable stiffness housing 124 positioned between the downhole motor 150 and the drill bit 118. In the embodiment shown, the downhole motor 150 and a variable stiffness housing 124 are positioned within the BHA 116 closest to the drill bit 18. In other embodiments, the downhole motor 150 and a variable stiffness housing 124 may be located in other areas along the drill string 114, including above the LWD/MWD tool 122 and telemetry sub 120 in the BHA 116, and coupled to the drill string 114 above the BHA 116. The downhole motor 150 may rotate the drill bit 118, causing it to extend the borehole 116. In certain embodiments, the downhole motor 150 may comprise a downhole mud motor with fluid driven turbine that rotates in response to the flow of drilling fluid through the drill string 114. The fluid driven turbine of the downhole motor 150 may comprise a rotor and a stator. The rotor may be coupled to and drive the drill bit 118 through a flexible drive shaft (not shown) extending through the variable stiffness housing 124.

The variable stiffness housing 124 may control, in part, the longitudinal axis 128 of the drill bit 118 with respect to the longitudinal axis 126 of the system 100 above the variable stiffness housing 124. In particular, the variable stiffness housing 124 may selectively bend to offset the longitudinal axis 128 of the drill bit 118 from the longitudinal axis 126 of the system 100 above the variable stiffness housing 124 by an angle 150 that corresponds to a bend angle of the variable stiffness housing 124. The offset may occur because the bend in the variable stiffness housing 124 is imparted to the flexible drive shaft (not shown) between the motor 150 and drill bit 118. By offsetting the longitudinal axis 128 from the longitudinal axis 126, the variable stiffness housing 124 may change the drilling direction of the system 100, which corresponds to the longitudinal axis 128 of the drill bit 118.

According to aspects of the present disclosure, the variable stiffness housing 124 may selectively bend in response to a weight applied to the drill bit 118 by the drilling system 100. This weight may be referred to as the "weight-on-bit" (WOB) and may be characterized by the weight of the elements between the drill bit 118 and the traveling block 138 less any frictional forces imparted on the drill string 114 by the borehole 110 and any weight born by the traveling block 138. The bend angle of the variable stiffness housing 124 may be based, in part, on the WOB and the stiffness characteristics of the variable stiffness housing 124. Additionally, as will be described in detail below, the stiffness characteristics of the variable stiffness housing 124 may be altered downhole to select when the variable stiffness housing 124 will bend in response to the WOB, the magnitude of the bend, and the orientation of the bend with respect to the longitudinal axis 126.

Figure 2A:
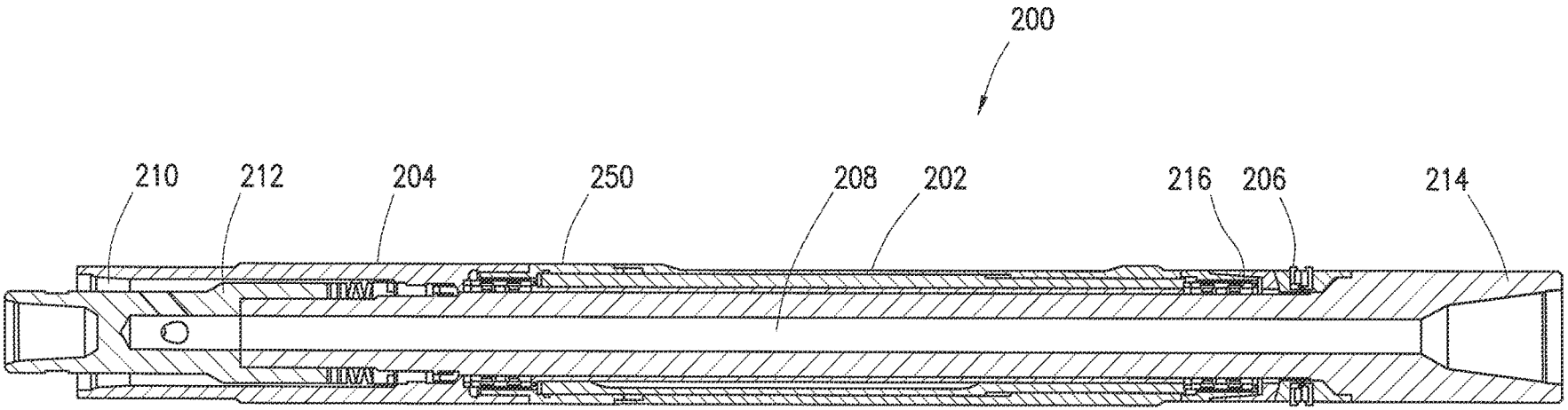
FIGS. 2A and 2B are diagrams illustrating an example downhole tool, according to aspects of the present disclosure.
Figure 2B:
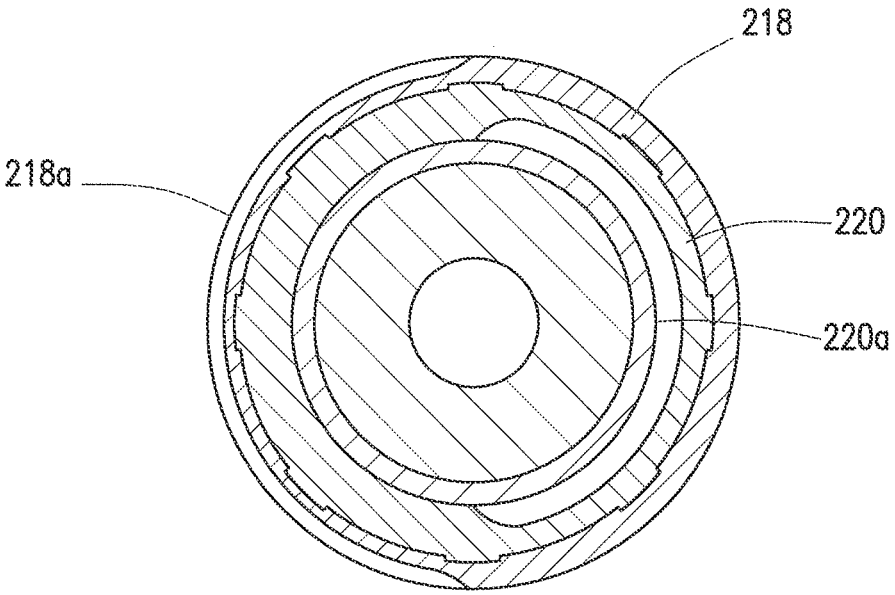

FIGS. 2A and 2B are diagrams illustrating an example downhole tool 200, according to aspects of the present disclosure. The tool 200 comprises a variable stiffness housing 202 positioned between a collar 204 and a bearing portion 206, and a drive shaft 208 at least partially within the variable stiffness housing 202. The collar 204 may comprise one or more engagement surfaces 210 through which the tool 200 may be coupled to other elements within a drilling assembly, such as a downhole motor or a drill pipe. The drive shaft 208 may be coupled to a downhole motor through an adapter 212 that is coupled to an end of the drive shaft 208 and imparts torque from the downhole motor to the drive shaft 208. The other end of the drive shaft 208 may comprise a bit sub 214 to which a drill bit (not shown) may be coupled during operation. The bit sub 214 may be integral with or coupled to the drive shaft 208. The bearing portion 206 may include one or more bearings 216 or other elements that facilitate rotation of the drive shaft 208 with respect to the variable stiffness housing 202, collar 204, and bearing portion 206.

In the embodiment shown, the variable stiffness housing 202 comprises an outer housing 218 and an inner housing 220 at least partially within and rotationally independent from the outer housing 218. The outer housing 218 and inner housing 220 may comprise elongated tubular structures formed of metal or another material that is sufficiently robust to withstand downhole conditions. In the embodiment shown, the outer housing 218 may be rotatable with respect to the collar 204 and the inner housing 218, which may itself be independently rotatable or rotationally fixed to the collar 204. A positioning device 250 may rotate the outer housing 218 with respect to the collar 204 and the inner housing 218.

In the embodiment shown, the positioning device 250 comprises an adjusting ring that can be used to selectively rotationally uncoupled from the collar 204, so that the rotational orientation with respect to the collar 204 can be changed.

In certain embodiments, both the outer housing 218 and the inner housing 220 may have non-uniform stiffness characteristics characterized by at least one portion of each outer housing 218 and inner housing 220 with a lower stiffness value than another portion of the respective housings 218 and 220. The portions may be located at any axial, radial, or angular location with respect to the longitudinal axes of the outer housing 218 and inner housing 220. In the embodiment shown, the lower stiffness value portion of the inner housing 220 comprises a notched area 220*a* on an inner surface of the inner housing 220. Similarly, the lower stiffness value portion of the outer housing 218 comprises a notched area 218*a* on an outer surface of the outer housing 218. The notched areas 220*a* and 220*b* correspond to angular portions of the respective housings in which there is less structural material than at the other angular portions, thereby reducing the stiffness or rigidity of the housings at the notched areas 220*a* and 220*b*. The notched areas 220*a* and 220*b* may be formed when the outer housing 218 and inner housing 220 are molded or otherwise formed, for example, or provided after the outer housing 218 and inner housing 220 are formed, such as through the removal of material from the structure of the housing.

The stiffness characteristics for the variable stiffness housing 124 may depend, in part, on the relative orientation of the notched areas 220*a* and 220*b*, such that the stiffness characteristics for the variable stiffness housing 124 may be altered by rotating the outer housing 218 with respect to the inner housing 220. In the embodiment shown, the notched areas 220*a* and 220*b* may be positioned relative to one another to prevent or allow the variable stiffness housing 124 to bend, and to control the magnitude of the bend angle at the variable stiffness housing 124. Specifically, when the notched areas 220*a* and 220*b* do not angularly overlap, the variable stiffness housing 124 may have a near uniform stiffness value at all angular orientations, such that the variable stiffness housing 124 does not bend in response to a known WOB. In contrast, when the notched areas 220*a* and 220*b* wholly or partially overlap, the variable stiffness housing 124 may have an angular portion with a lower stiffness value than the rest of the variable stiffness housing 124 such that the variable stiffness housing 124 may bend in response to a known WOB. Notably, the bend angle of the variable stiffness housing 124 in response to a particular WOB may be at a maximum when there is complete overlap between the notched areas 220*a* and 220*b*.

Generally, the magnitude of the bend angle of the housing 124 depends on the stiffness of the housing 124 and the applied WOB. For a particular stiffness value, the magnitude of the bend angle positively correlates to the applied WOB, with the magnitude of the bend angle increasing when the applied WOB increases, and vice versa. For a particular applied WOB, the magnitude of the bend angle negatively correlates to the stiffness, with the magnitude of the bend angle decreasing when the stiffness increases, and vice versa. In certain embodiments, the magnitude of the bend angle of the housing 124 may be known for a range of stiffness values available at the housing 124 and over a range of WOB values. The corresponding combination of stiffness and applied WOB may then be selected to achieve a desired bend angle.

In use, a drilling system incorporating the tool 200 may be disposed within a borehole, and drilling may proceed by applying a WOB to a drill bit attached to the tool 200 and pumping drilling fluid downhole to rotate a downhole motor and the drill bit. In certain instances, the tool 200 may begin with the notched areas 220*a* and 220*b* not aligned such that the variable stiffness housing 124 does not bend in response to the applied WOB. This may be referred to as a "straight ahead" mode because without a bend in the variable stiffness housing 124, the drill string, BHA, and drill bit are substantially aligned and the drill bit will drill in a generally straight line. At a certain point, it may become necessary to drill at an angle from the current direction in which the borehole is being drilled. At that point, the tool 200 may be lifted to the surface via a drill string, and the adjusting ring 250 used to rotate the outer housing 218 with respect to the inner housing 220 to wholly or partially rotationally align the notched areas 220*a* and 220*b*, such that the variable stiffness housing 124 bends in response to the WOB. This may be referred to a "directional drilling" mode in which the bend at the variable stiffness housing 124 causes the drill bit to drill at an offset angle from the remainder of the drill string. The magnitude of the offset angle may depend, in part, on the amount of alignment between the notched areas 220*a* and 220*b*.

Figure 3A:
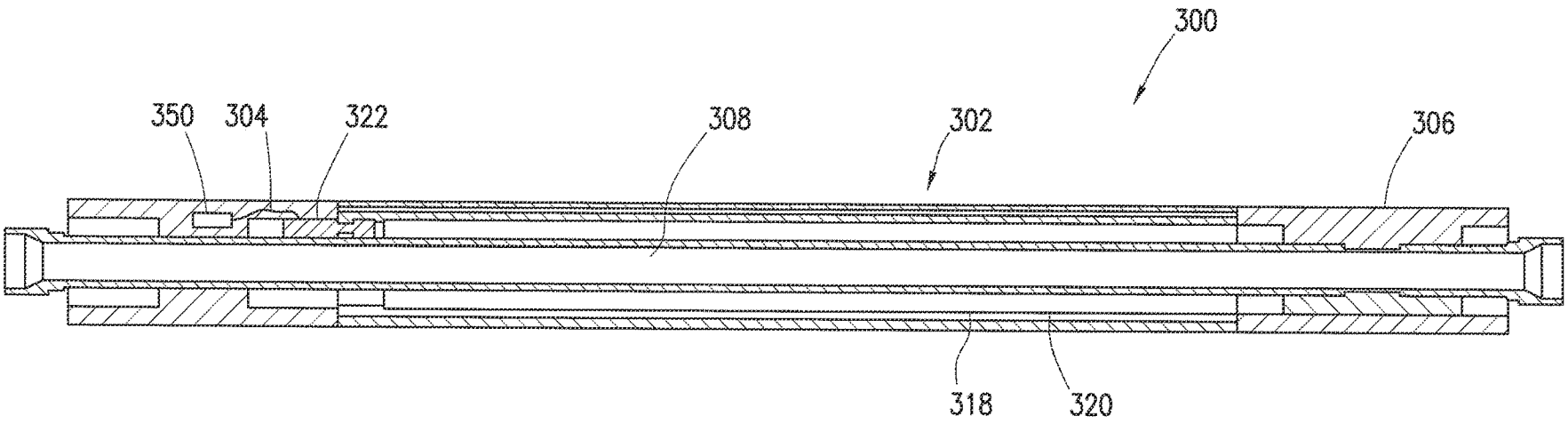

FIGS. 3A and 3B are diagrams illustrating another example downhole tool 300, according to aspects of the present disclosure. Like the tool described above, the tool 300 comprises a variable stiffness housing 302 positioned between a collar 304 and a bearing portion 306, and a drive shaft 308 at least partially within the variable stiffness housing 302. Also like the tool described above, the variable stiffness housing, 302 comprises an outer housing 318 and an inner housing 320 at least partially within and rotationally independent from the outer housing 320. In the embodiment shown, however, the outer housing 318 is rotationally fixed to the collar 304 within the inner housing 320 being rotatable with respect to the outer housing 318. In this embodiment, a positioning device 322 in the form of an electric motor is included in the collar 304 to rotate and position the inner housing 320 with respect to the outer housing, 318. The electric motor may, for example, receives power and commands from a respective power source and control unit located within the collar 304 or outside of the collar 304 in the downhole motor. In other embodiments, the positioning device 322 may comprise a fluid drive turbine, a clutch mechanism that selectively attaches the inner housing 320 to the drive shaft 308, or other means that would be appreciated by one of ordinary skill in the art in view of this disclosure.

In the embodiment shown, both the outer housing 318 and the inner housing 320 may have non-uniform stiffness characteristics characterized by respective angular portions 318*a* and 320*a* with lower stiffness values caused by longitudinal holes having been drilled through the structural material of the outer and inner housings 318/320. Like the notched areas described above, the longitudinal holes displace structural materials such that there is less structural material to withstand compressive forces, such as WOB, causing the housing to bend when subjected to such forces. The longitudinal holes may be formed when the outer housing 318 and inner housing 320 are molded or otherwise formed, for example, or provided after the outer housing 318 and inner housing 320 are formed, such as through the removal of material from the structure of the housing.

In certain embodiments, the tool 300 may comprise a control unit 350 located within the collar 304 that, in part, manages and controls the relative rotational orientation of the inner housing 320 with respect to the outer housing 318 by controlling the motor 322. In particular, the control unit 350 may signal the electric motor 322 to rotate the inner housing 320 to, for example, cause the portions 318*a* and 320*a* to move into or out of rotational alignment, or to alter the degree of rotational alignment between the portions 318*a* and 320*a*, in certain embodiments, sensors (not shown) may be incorporated into one or both of the inner housing 320 and outer housing 318, and the control unit 350 may receive measurements from the sensors that can be used to identify the relative rotational orientation of the inner housing 320 and outer housing 318. The control unit 350 may signal the electric motor 322 in response to a command from a control unit located elsewhere within the drilling system, or it may signal the motor 322 without an external command. In other embodiments, the control unit 350 may be located at other positioned within the drilling system, such as downhole outside of the tool 300, or at the surface.

As used herein, a control unit may comprise a processor, examples of which include microprocessors, microcontrollers, digital signal processors (DSP), application specific integrated circuit (ASIC), or any other digital or analog circuitry configured to interpret and/or execute program instructions and/or process data. The control unit may further comprise a memory element communicably coupled to the processor. The processor may be configured to interpret and/or execute program instructions and/or data stored in memory. Example memory elements comprise non-transitory computer readable media that may include any system, device, or apparatus configured to hold and/or house one or more memory modules; for example, memory may include read-only memory, random access memory, solid state memory, or disk-based memory. Each memory module may include any system, device or apparatus configured to retain program instructions and/or data for a period of time (e.g., computer-readable non-transitory media).

As described above, the inner and outer housings 320/318 may be rotationally oriented with respect to one another to control the bend angle of the tool. FIG. 3B illustrates three example orientations. Orientation (a) illustrates the variable stiffness housing 302 when the portions 318*a*/320*a* or the respective outer and inner housings 318/320 have been fully rotationally aligned. This orientation may correspond to a maximum bend angle of the variable stiffness housing 302 in the direction indicated by arrow 306. The direction of the bend 306 is at the angular center of the overlapping areas of the portions 318*a*/320*a*. Orientation (b) illustrates the variable stiffness housing 302 when the portions 318*a*/320*a* or the respective outer and inner housings 318/320 have been partially rotationally aligned. Because part of each portion 318*a*/320*a* rotationally overlaps with higher stiffness portions of the housings 318/320, the effective stiffness value of the variable stiffness housing 302 is higher, meaning that the bend angle is smaller than in orientation (a) when the same WOB is applied. Additionally, the direction of the bend 306 has changed to track the angular center of the overlapping areas of the portions 318*a*/320*a*. Orientation (c) illustrates the variable stiffness housing 302 when the portions 318*a*/320*a* or the respective outer and inner housings 318/320 are not aligned. Because all of the portions 318*a*/320*a*, rotationally overlap with higher stiffness portions of the housings 318/320, the entire variable stiffness housing 300 can withstand the WOB without bending.

Notably, the stiffness values for the housings 318/320 may be determined and selected to correspond to particular WOB values likely to be encountered in a drilling operation. Specifically, the lower stiffness value portions 318*a*/320*a* of the housings 318/320 may be designed such that when they rotationally overlap with each other, the combined stiffness value is low enough that the entire variable stiffness housing 302 will bend in response to a given WOB. Likewise, the lower stiffness value portions 318*a*/320*a* and other portions of the housings 318/320 may be designed or selected such that when the lower stiffness value portions 318*a*/320*a* are not aligned, the effective stiffness value of the variable stiffness housing 302 is high enough to withstand the WOB without bending. With respect to housings 318/320, the stiffness values of the portions 318*a*/320*a* may depend, in part, on the number, size and orientation of longitudinal holes through the housing 318*a*/320*a*, whereas the stiffness value of the other portions of the housings 318/320 may depend on the characteristics of the structural materials used to form the housing 318/320.

Figure 4:
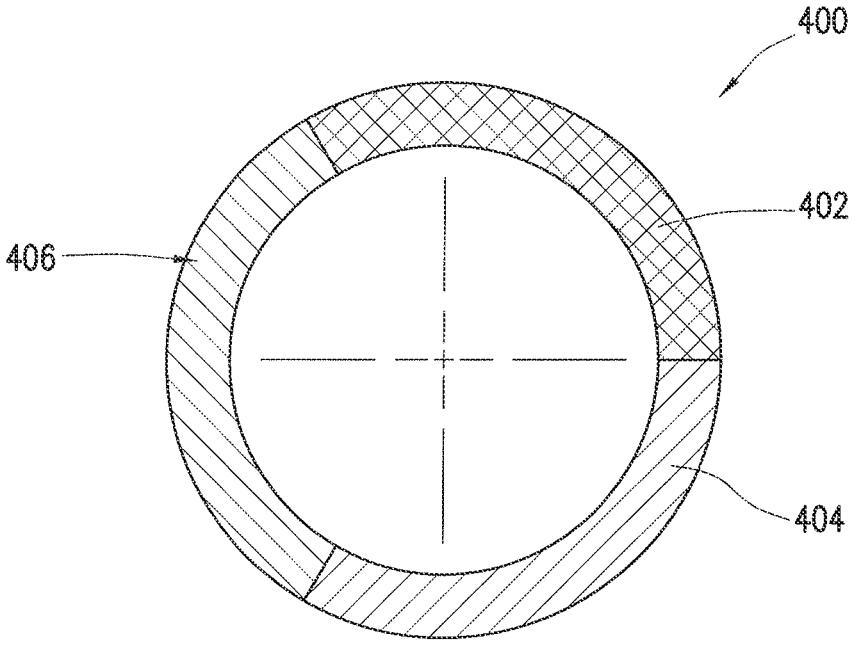
FIG. 4 is a diagram illustrating an example housing with non-uniform stiffness, according to aspects of the present disclosure.

Other embodiments of tools incorporating variable stiffness housings are possible in addition to those described above. For example, in certain embodiments, both the inner and outer housings may be rotatable to allow for maximum control of the bend angle and direction. Additionally, other embodiments of variable stiffness housings are possible in addition to those described above. For instance, in certain embodiments, at least one of the inner and outer housing may be made out of a plurality of materials, some of which may have a different stiffness than others. FIG. 4 is a diagram of such an example housing 400. In the embodiment shown, the housing 400 is characterized by non-uniform stiffness due to its construction with multiple materials, each confined to an angular ranges 402/404/406 of the housing 400. Each of the materials may comprise different stiffness such that the housing 400 may be rotationally oriented with respect to another housing, as described above, to allow for bending to occur and to provide multiple different bend angles corresponding to the same WOB. Although three equal angular ranges 402/404/406 are shown in housing 400, other numbers of materials and angular orientations may be used. Additionally, the different materials may comprise the same base material with different composite additives to alter the stiffness, or alloys having different percentages of base ingredients.

In yet other embodiments, a variable stiffness housing may comprise a single tubular structure rather than the inner and outer housing, configuration described above. In those embodiments, the housing may be manufactured out of a material whose stiffness may change due to interaction with external stimuli. For example, the housing may be to out of material with stiffness that changes in response to thermal or chemical changes, such as those that occur when the housing is lowered to depth in a borehole and positioned within drilling fluid in the borehole. The housing may also be manufactured out of material with stiffness that reacts to electromagnetic stimuli. In those instances, an electrical signal, magnetic field, and/or electrical field may be generated at the housing to alter the stiffness of the housing and allow the housing to bend.

According to aspects of the present disclosure, an example apparatus for controlling the direction of drilling a borehole includes an outer housing having non-uniform stiffness and an inner housing at least partially within and rotationally independent from the outer housing and having non-uniform stiffness. A drive shall may be at least partially within the inner housing. In certain embodiments, at least one of the outer housing and the inner housing may include a tubular structure with at least one of multiple materials with different stiffness, and a portion with less structural material than another portion.

In certain embodiments, the portion of the tubular structure with less structural material than another portion comprises at least one axial, radial, or angular portion of the tubular structure with at least one of a notched area on a surface thereof and a series of longitudinal holes therethrough. In certain embodiments, the multiple materials with different stiffness characteristics comprise at least one composite material positioned at an axial, radial, or angular portion of the tubular structure. In certain embodiments, the multiple materials with different stiffness characteristics comprise at least two materials positions at different axial, radial, or angular portions of the tubular structure.

In any of the embodiment described in the preceding two paragraphs, the apparatus may further include a positioning device to rotate one of the inner housing and the outer housing with respect to the other one of the inner housing and the outer housing. In certain embodiments, the positioning device comprises an electric motor coupled to the inner housing. In certain embodiments, the positioning device comprises an adjusting ring coupled to the outer housing.

According to aspects of the present disclosure, an example method for controlling the direction of drilling a borehole may include drilling a borehole in a first direction in a subterranean formation and altering a stiffness characteristic of a housing within the borehole. The borehole may be drilled in a second direction in the subterranean formation, the second direction based, at least in part, on the altered stiffness characteristic of the housing. In certain embodiments, altering the stiffness characteristic of the housing within the borehole comprises rotating one of an inner housing having non-uniform stiffness and an outer housing having non-uniform stiffness with respect to the other one of the inner housing having non-uniform stiffness and the outer housing having non-uniform stiffness.

In certain embodiments, at least one of the outer housing and the inner housing comprises a tubular structure with at least one of multiple materials with different stiffness, and a portion with less structural material than another portion. In certain embodiments, at least one of the outer housing and the inner housing comprises a tubular structure with at least one of multiple materials with different stiffness, and a portion with less structural material than another portion. In certain embodiments, altering the stiffness characteristic of a housing within the borehole comprises at least one of changing a thermal condition of the housing; altering a chemical condition of the housing; and applying at least one of an electrical signal, a magnetic field, and an electrical field to the housing.

In any embodiment described in the preceding two paragraphs, drilling the borehole in the first direction in the subterranean formation may comprise applying a weight on a drill bit within the borehole and rotating the drill bit using a drive shaft at least partially disposed within the housing; and drilling the borehole in the second direction in the subterranean formation may comprise applying the same weight on the drill bit within the borehole and rotating the drill bit using the drive shaft. In certain embodiments, rotating the drill bit using the drive shaft comprises rotating the drill bit uses a downhole motor coupled to the drill bit though the drive shaft.

According to aspects of the present disclosure, an example system for controlling the direction of drilling a borehole includes a variable stiffness housing and a drive shaft at least partially within the variable stiffness housing. A downhole motor may be coupled to the drive shaft and the variable stiffness housing. A drill bit may be coupled to the drive shaft. In certain embodiments, the variable stiffness housing comprises an outer housing having non-uniform stiffness; and an inner housing at least partially within and rotationally independent from the outer housing and having non-uniform stiffness.

In certain embodiments, the system further includes at least one of an adjusting ring coupled to the outer housing and an electric motor coupled to the inner housing. In certain embodiments. In certain embodiments, at least one of the outer housing and the inner housing comprises a tubular structure with at least one of multiple materials with different stiffness, and a portion with less structural material than another portion. In certain embodiments, the portion of the tubular structure with less structural material than another portion comprises at least one axial, radial, or angular portion of the tubular structure with at least one of a notched area on a surface thereof and a series of longitudinal holes therethrough. In certain embodiments, the multiple materials with different stiffness characteristics comprises at least one of a composite material positioned at an axial, radial, or angular portion of the tubular structure; multiple materials with different stiffness characteristics comprise at least two materials positions at different axial, radial, or angular portions of the tubular structure. In certain embodiments, the variable stiffness housing comprises at least one of a shape memory alloy, a piezoelectric material, and a piezoresistive material The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces. Additionally, the terms "couple" or "coupled" or any common variation as used in the detailed description or claims are not intended to be limited to a direct coupling. Rather two elements may be coupled indirectly and still be considered coupled within the scope of the detailed description and claims.

What is claimed is:

1. An apparatus for controlling the direction of drilling a borehole by a drilling system, comprising:

an outer housing having non-uniform stiffness, wherein the non-uniform stiffness of the outer housing is due to the outer housing comprising a plurality of materials, wherein each of the plurality of materials is confined to a corresponding angular range of the outer housing, and wherein the outer housing selectively bends in response to a weight applied to a drill bit of the drilling system;

an inner housing at least partially within and rotationally independent from the outer housing and having non-uniform stiffness; and a drive shaft at least partially within the inner housing.

2. The apparatus of claim 1, wherein at least one of the outer housing and the inner housing comprises a tubular structure with at least one of multiple materials with different stiffness, and a portion with less structural material than another portion.

3. The apparatus of claim 2, wherein the portion of the tubular structure with less structural material than another portion comprises at least one axial, radial, or angular portion of the tubular structure with at least one of a notched area on a surface thereof and a series of longitudinal holes therethrough.

4. The apparatus of claim 2, wherein the multiple materials with different stiffness characteristics comprise at least one composite material positioned at an axial, radial, or angular portion of the tubular structure.

5. The apparatus of claim 2, wherein the multiple materials with different stiffness characteristics comprise at least two materials positions at different axial, radial, or angular portions of the tubular structure.

6. The apparatus of claim 1, further comprising a positioning device to rotate one of the inner housing and the outer housing with respect to the other one of the inner housing and the outer housing.

7. The apparatus of claim 6, wherein the positioning device comprises an electric motor coupled to the inner housing.

8. The apparatus of claim 6, wherein the positioning device comprises an adjusting ring coupled to the outer housing.

9. A method for controlling the direction of drilling a borehole, comprising:

drilling the borehole in a first direction in a subterranean formation by a drilling system, wherein a non-uniform stiffness of a housing of the drilling system is due to the housing comprising a plurality of materials, wherein each of the plurality of materials is confined to a corresponding angular range of the housing, and;

altering a stiffness characteristic of the non-uniform stiffness of the housing of the drilling system, wherein the housing selectively bends in response to a weight applied to a drill bit of the drilling system;

drilling the borehole in a second direction in the subterranean formation by the drilling system, the second direction based, at least in part, on the altered stiffness characteristic of the housing.

10. The method of claim 9, wherein the housing comprises an inner housing having non-uniform stiffness and an outer housing having non-uniform stiffness, and wherein altering the stiffness characteristic of the housing within the borehole comprises rotating the outer housing with respect to the inner housing.

11. The method of claim 10, wherein at least one of the outer housing and the inner housing comprises a tubular structure with at least one of multiple materials with different stiffness, and a portion with less structural material than another portion.

12. The method of claim 10, wherein at least one of the outer housing and the inner housing comprises a tubular structure with multiple materials with different stiffness, and a portion with less structural material than another portion.

13. The method of claim 9, wherein altering the stiffness characteristic of the housing within the borehole comprises at least one of changing a thermal condition of the housing;

altering a chemical condition of the housing; and applying at least one of an electrical signal, a magnetic field, and an electrical field to the housing.

14. The method of claim 9, wherein drilling the borehole in the first direction in the subterranean formation comprises applying the weight on the drill bit within the borehole and rotating the drill bit using a drive shaft at least partially disposed within the housing; and drilling the borehole in the second direction in the subterranean formation comprises applying the same weight on the drill bit within the borehole and rotating the drill bit using the drive shaft.

15. The method of claim 14, wherein rotating the drill bit using the drive shaft comprises rotating the drill bit uses a downhole motor coupled to the drill bit through the drive shaft.

16. A system for controlling the direction of drilling a borehole, comprising:

a variable stiffness housing, wherein the variable stiffness of the housing is due to the housing comprising a plurality of materials, wherein each of the plurality of materials is confined to a corresponding angular range of the housing, and;

a drive shaft at least partially within the variable stiffness housing;

a downhole motor coupled to the drive shaft and the variable stiffness housing; and a drill bit coupled to the drive shaft, wherein the variable stiffness housing selectively bends in response to a weight applied to the drill bit of the drilling system.

17. The system of claim 16, wherein the variable stiffness housing comprises an outer housing having non-uniform stiffness; and an inner housing at least partially within and rotationally independent from the outer housing and having non-uniform stiffness.

18. The system of claim 17, further comprising at least one of an adjusting ring coupled to the outer housing and an electric motor coupled to the inner housing.

19. The system of claim 17, wherein at least one of the outer housing and the inner housing comprises a tubular structure with at least one of multiple materials with different stiffness, and a portion with less structural material than another portion.

20. The system of claim 19, wherein the portion of the tubular structure with less structural material than another portion comprises at least one axial, radial, or angular portion of the tubular structure with at least one of a notched area on a surface thereof and a series of longitudinal holes therethrough.

21. The system of claim 19, wherein at least one of the multiple materials with different stiffness characteristics comprises a composite material positioned at an axial, radial, or angular portion of the tubular structure, and the multiple materials with different stiffness characteristics comprise at least two materials positioned at different axial, radial, or angular portions of the tubular structure.

22. The system of claim 16, wherein the variable stiffness housing comprises at least one of a shape memory alloy, a piezoelectric material, and a piezoresistive material.

* * * * *